US010725408B2

(12) United States Patent
Nakabo et al.

(10) Patent No.: US 10,725,408 B2
(45) Date of Patent: Jul. 28, 2020

(54) FIXING DEVICE, IMAGE FORMING DEVICE, AND PRESSURE CONTACT STATE SWITCHING DEVICE

(71) Applicant: KONICA MINOLTA, INC., Chiyoda-ku, Tokyo (JP)

(72) Inventors: Masashi Nakabo, Toyokawa (JP); Naoki Kataoka, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/381,166

(22) Filed: Apr. 11, 2019

(65) Prior Publication Data

US 2019/0332043 A1 Oct. 31, 2019

(30) Foreign Application Priority Data

Apr. 25, 2018 (JP) ..... 2018-084418

(51) Int. Cl.
*G03G 15/20* (2006.01)

(52) U.S. Cl.
CPC ..... *G03G 15/2053* (2013.01)

(58) Field of Classification Search
None
See application file for complete search history.

(56) References Cited

U.S. PATENT DOCUMENTS

2012/0027477 A1* 2/2012 Nakayama ..... G03G 15/2064 399/328
2016/0370744 A1 12/2016 Kataoka et al.

FOREIGN PATENT DOCUMENTS

JP 2014219699 A 11/2014
JP 2017009792 A 1/2017

* cited by examiner

*Primary Examiner* — Victor Verbitsky
(74) *Attorney, Agent, or Firm* — Buchanan Ingersoll & Rooney PC

(57) ABSTRACT

A fixing device fixing a toner image onto a recording sheet passing through a nip, the fixing device including: a pressure structure and a heating structure forming the nip when in pressure contact; and a switching unit selectively switching a pressure contact state of the heating structure and the pressure structure between a first state, a second state, and a release state. The switching unit includes: a first switcher directly switching the pressure contact state between the first state and the second state without switching the pressure contact state to the release state; a second switcher switching the pressure contact state between the first state and the release state; an acquirer acquiring information relating to which state the pressure contact state is to be switched into; and a controller controlling the first switcher and the second switcher based on the acquired information to switch the pressure contact state.

14 Claims, 12 Drawing Sheets

Full pressure contact state

Separated state

Light pressure contact state

FIXING DEVICE, IMAGE FORMING DEVICE, AND PRESSURE CONTACT STATE SWITCHING DEVICE

This application claims priority to Japanese Patent Application No. 2018-084418 filed Apr. 25, 2018, the contents of which are hereby incorporated herein by reference in its entirety.

BACKGROUND

[Technical Field]

The present disclosure relates to fixing devices switching a pressure contact state of a heating structure and a pressure structure, image forming devices including such fixing devices, and pressure contact state switching devices used in such fixing devices, image forming devices, or the like.

[Description of the Related Art]

In electrophotographic image forming devices, an electrostatic latent image is formed by exposing and scanning a surface of a photoreceptor by light on the basis of image data of a document, supplying toner to the electrostatic latent image to form a toner image, transferring the toner image onto a recording sheet, and heat-fixing the toner image in a fixing device.

In a typical fixing device, a recording sheet is passed through a nip formed between a heated fixing roller (fixing rotational body) and a pressure roller (pressure rotational body) that is in pressure contact with the fixing roller and the recording sheet is conveyed forward while the toner image thereon is heat-fixed. When the recording sheet is jammed at the nip, the pressure contact of the pressure roller and the heating roller needs to be released by moving the pressure roller away from the heating roller in order to deal with the sheet jam.

Further, when special paper such as an envelope is passed through the nip, the special paper may wrinkle or the like under a strong pressure contact force. Accordingly, the pressure contact force when special paper is passed through the nip is beneficially smaller than a pressure contact force when plain paper is passed through (a contact state that is used when fixing a toner image on plain paper is hereinafter referred to as "full pressure contact state", and a contact state that is used when fixing a toner image on special paper such as an envelope with use of a pressure contact force smaller than in the full pressure contact state is hereinafter referred to as "light pressure contact state").

Thus, in recent years, a fixing device including a pressure contact state switching mechanism that is configured to switch a state of the fixing rotational body and the pressure rotational body (pressure contact state) between three states, namely the full pressure contact state, the light pressure contact state, and a release state, has been proposed (for example, Japanese Patent Application Publication No. 2017-009792 (hereinafter referred to as JP2017-009792)).

FIG. 12A, FIG. 12B, and FIG. 13 are schematic diagrams of a structure of a pressure contact state switching mechanism 50 in a fixing device pertaining to JP2017-009792.

In FIG. 12A, a heating roller 96 is supported by a main frame that is not illustrated, a pressure roller 97 is supported by a sub frame 60 through a shaft 27, and the sub frame 60 is supported at a lower end 51 of the sub frame 60 by the main frame through a swing shaft 28 to be swingable about the swing shaft 28. Due to this, by swinging the sub frame 60 clockwise, the heating roller 96 and the pressure roller 97 come to be in pressure contact.

A swing arm 52 is supported by the main frame through a swing shaft 56 to be swingable about the swing shaft 56, and an operation lever 62 is supported by the main frame through a swing shaft 65 to be swingable about the swing shaft 65. A pin 64 stands at an upper portion of the operation lever 62 towards a back of the fixing device and engages with a slot 63 of the swing arm 52. Due to this, a crank mechanism in which the swing arm 52 swings upwards and downwards about the swing shaft 56 in accordance with rotation of the operation lever 62 is formed.

A tension spring 53 for full pressure contact stretches between a spring hooking portion 61 at a right end of the swing arm 52 and a spring hooking portion 57 at an upper end of the sub frame 60. In the full pressure contact state in FIG. 12A, the tension spring 53 biases the sub frame 60 to rotate clockwise.

Further, at a back of the sub frame 60 relative to the front of the fixing device, a light pressure contact arm 54 overlapped with the sub frame 60 is supported by the main frame through the swing shaft 28 to be swingable about the swing shaft 28.

Between an upper portion of the light pressure contact arm 54 and a spring receiving portion 58 of the sub frame 60 is a compression spring 59 provided for light pressure contact and having a smaller spring constant than the tension spring 53.

In the state in FIG. 12A, the tension spring 53 for full pressure contact is extended and a restoring force of the tension spring 53 biases the sub frame 60 to the right, and therefore the pressure contact state is switched to the full pressure contact state. Here, a base end 55 of the operation lever 62 is not in contact with the light pressure contact arm 54, and therefore the compression spring 59 for light pressure contact has is at its natural length and does not bias the sub frame 60.

When the operation lever 62 is greatly rotated clockwise as in FIG. 12B, a left side of the swing arm 52 inclines downwards due to a crank function caused by engagement of the pin 64 of the operation lever 62 and the slot 63 of the swing arm 52. Thus, the spring hooking portion 61 of the swing arm 52 approaches the spring hooking portion 57 of the sub frame 60, and the tension spring 53 returns to its natural length and no longer biases the sub frame 60.

Further, a distance between the light pressure contact arm 54 and the spring receiving portion 58 does not change, and therefore the compression spring 59 remains at the natural length and does not bias the sub frame 60. Accordingly, the heating roller 96 and the pressure roller 97 are switched to a state in which pressure contact between the heating roller 96 and the pressure roller 97 is released (separated state).

When the operation lever 62 is caused to further rotate clockwise as in FIG. 13, while the swing arm 52 inclines further due to the crank function, a protrusion 66 of the operation lever 62 abuts against the upper portion of the light pressure contact arm 54 and causes the light pressure contact arm 54 to incline to the right. Accordingly, the tension spring 53 for full pressure contact remains at the natural length, the upper portion of the light pressure contact arm 54 approaches the spring receiving portion 58 of the sub frame 60, and therefore the compression spring 59 exerts an elastic force (restoring force) that biases the sub frame 60 to swing to the right (clockwise). Due to this, the heating roller 96 and the pressure roller 97 are switched to the light pressure contact state.

Switching from the light pressure contact state to the full pressure contact state is achieved by performing reverse operations of the above.

In the structure of JP2017-009792 above, a user has to open a door for maintenance of the image forming device and operate the operation lever 62 in order to switch the pressure contact state. Typically, when the door for maintenance is opened, supply of electric power to a driver including the fixing device is temporarily stopped for security. The image forming device is booted when the door is closed. However, a certain time period is required before image forming is performed, and therefore a forthcoming image forming job cannot be performed promptly.

Thus, in recent years, a demand for a structure in which the pressure contact state is switched automatically with use of a drive motor or the like is increasing.

However, even when the operation lever 62 described above is swung automatically by using a drive motor or the like, the fixing device of JP2017-009792 above inevitably switches the pressure contact state to the release state when switching the pressure contact state from the full pressure contact state to the light pressure contact state or from the light pressure contact state to the full pressure contact state as described above. Switching to the release state requires a certain time period, and a time period required before the first page of the forthcoming image forming job is output (Fcot: first copy time) becomes longer accordingly.

SUMMARY

An object of the present disclosure is to provide a fixing device in which a time period during which the user has to wait in order to perform the forthcoming image forming job is shortened when the pressure contact state is switched by a drive source between a first pressure contact state and a second pressure contact state that uses a pressure contact force differing from the pressure contact force used in the first pressure contact state, an image forming device including such a fixing device, and a pressure contact state switching device used in such devices or the like.

To achieve at least one of the abovementioned objects, according to an aspect of the present disclosure, a fixing device reflecting one aspect of the present disclosure is a fixing device fixing an unfixed toner image onto a recording sheet by passing the recording sheet through a nip, the fixing device including: a pressure structure and a heating structure that form the nip when in pressure contact with each other; and a pressure contact state switching unit selectively switching a pressure contact state of the heating structure and the pressure structure between a first pressure contact state, a second pressure contact state, and a release state. The pressure contact state switching unit includes: a first switcher directly switching the pressure contact state between the first pressure contact state and the second pressure contact state without switching the pressure contact state to the release state; a second switcher switching the pressure contact state between the first pressure contact state and the release state; an acquirer acquiring information relating to which state the pressure contact state is to be switched into; and a controller controlling the first switcher and the second switcher based on the information acquired by the acquirer through driving the first switcher or the second switcher to switch the pressure contact state.

Further, an image forming device reflecting one aspect of the present disclosure is an image forming device including: a transferring unit transferring a toner image on a recording sheet; and a fixing device that fixes the toner image on the recording sheet. The fixing device fixes the toner image onto the recording sheet by passing the recording sheet through a nip, the fixing device including: a pressure structure and a heating structure that form the nip when in pressure contact with each other; and a pressure contact state switching unit selectively switching a pressure contact state of the heating structure and the pressure structure between a first pressure contact state, a second pressure contact state, and a release state. The pressure contact state switching unit includes: a first switcher directly switching the pressure contact state between the first pressure contact state and the second pressure contact state without switching the pressure contact state to the release state; a second switcher switching the pressure contact state between the first pressure contact state and the release state; an acquirer acquiring information relating to which state the pressure contact state is to be switched into; and a controller controlling the first switcher and the second switcher based on the information acquired by the acquirer through driving the first switcher or the second switcher to switch the pressure contact state.

Further, a pressure contact state switching device reflecting one aspect of the present disclosure is a pressure contact state switching device selectively switching a pressure contact state of a first structure and a second structure between a first pressure contact state, a second pressure contact state, and a release state, the pressure contact state switching device including: a first switcher directly switching the pressure contact state between the first pressure contact state and the second pressure contact state without switching the pressure contact state to the release state; a second switcher switching the pressure contact state between the first pressure contact state and the release state; an acquirer acquiring information relating to which state the pressure contact state is to be switched into; and a controller controlling the first switcher and the second switcher based on the information acquired by the acquirer through driving the first switcher or the second switcher to switch the pressure contact state.

BRIEF DESCRIPTION OF THE DRAWINGS

The advantages and features provided by one or more embodiments of the disclosure will become more fully understood from the detailed description given hereinbelow and the appended drawings which are given by way of illustration only, and thus are not intended as a definition of the limits of the invention. In the drawings.

DETAILED DESCRIPTION

Hereinafter, one or more embodiments of the present disclosure will be described with reference to the drawings. However, the scope of the invention is not limited to the disclosed embodiments.

The following describes an example in which a pressure contact state switching mechanism pertaining to an embodiment of the present disclosure is applied to a fixing device of a tandem-type color printer (hereinafter simply referred to as "printer"), with reference to the drawings.

(1) Overall Structure of Printer

Figure 1:
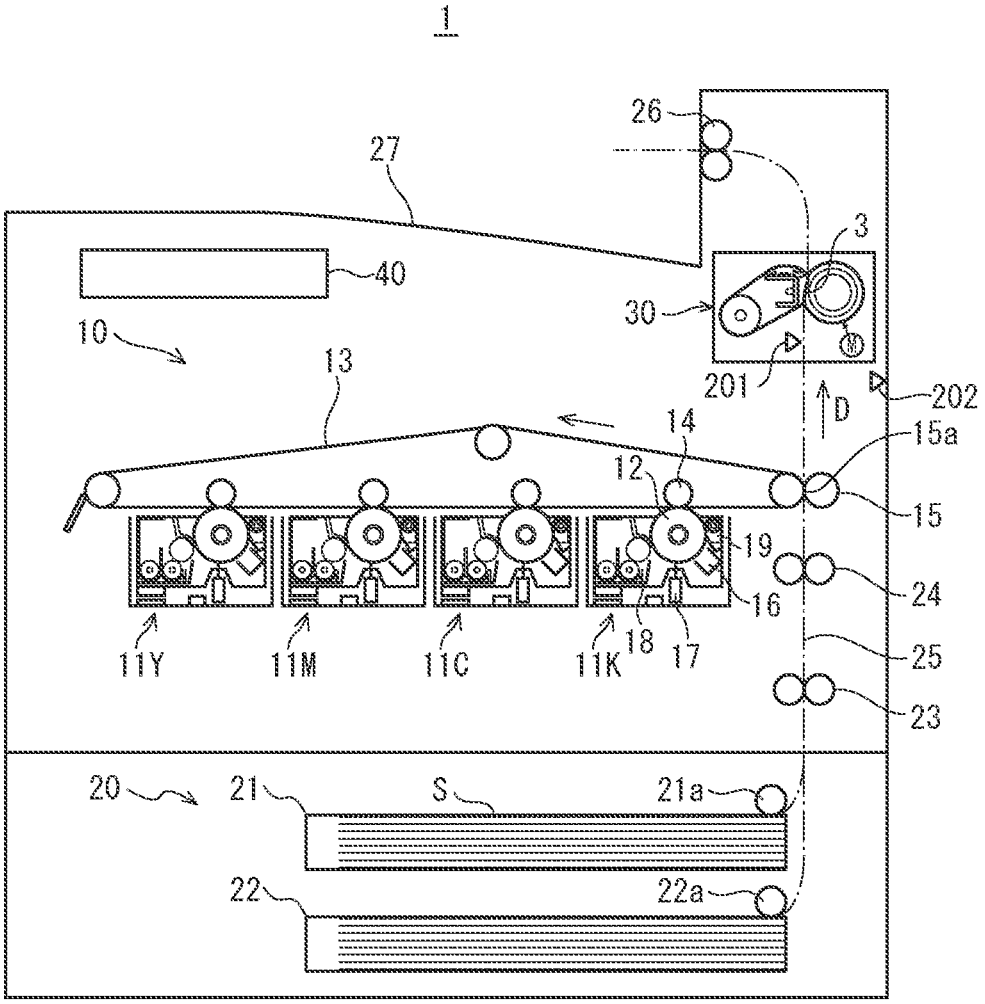
FIG. 1 is a schematic diagram for describing a structure of a tandem-type color printer that is an example of an image forming device pertaining to an embodiment of the present disclosure.

FIG. 1 is a schematic cross-sectional diagram of an overall structure of a printer 1.

In FIG. 1, the printer 1 includes an image forming section 10, a sheet feed section 20, and a fixing device 30.

The image forming section 10 includes an imaging unit 11Y corresponding to the color yellow (Y), an imaging unit 11M corresponding to the color magenta (M), an imaging unit 11C corresponding to the color cyan (C), an imaging unit 11K corresponding to the color black (K), and an intermediate transfer belt 13.

The imaging unit 11K includes a photoreceptor drum 12, and further includes a charger 16, a light exposer 17, a developer 18, and a cleaner 19 that are arranged along a circumferential direction of the photoreceptor drum 12.

The light exposer 17 includes components such as a light-emitting element (e.g. laser diode), a lens, and the like, and modulates laser light by using a drive signal from a controller 40 to expose and scan the photoreceptor drum 12.

The photoreceptor drum 12 is rotatably driven by a drive source that is not illustrated. Before the light exposure described above is performed, toner remaining on a surface of the photoreceptor drum 12 is removed with use of the cleaner 19, and the surface of the photoreceptor drum 12 is uniformly charged by the charger 16. When the charged surface of the photoreceptor drum 12 is exposed by laser light, an electrostatic latent image is formed onto the surface of the photoreceptor drum 12.

The electrostatic latent image formed on the photoreceptor drum 12 is developed by the developer 18. Due to this, a toner image of the color K is formed onto the surface of the photoreceptor drum 12. The toner image of the color K is transferred by a primary transfer roller 14 from the photoreceptor drum 12 onto the intermediate transfer belt 13 that travels in circulation (primary transfer). The primary transfer roller 14 is disposed on an opposite side of the intermediate transfer belt 13 from the photoreceptor drum 12.

The imaging units 11Y, 11M, and 11C each have a structure similar to the structure of the imaging unit 11K, and the imaging units 11Y, 11M, and 11C respectively form toner images of the corresponding color (Y, M, and C) on the corresponding photoreceptor drums 12 and the toner images are transferred onto the intermediate transfer belt 13 by the primary transfer rollers 14 (primary transfer).

Imaging operations of the imaging units 11Y, 11M, 11C, and 11K are performed at different timings in order for the toner images to be transferred at the same position on the intermediate transfer belt 13 in the primary transfer. Due to this, a color toner image is formed on the intermediate transfer belt 13.

The sheet feed section 20 includes sheet feed cassettes 21 and 22 each storing recording sheets S, and further includes pickup rollers 21*a* and 22*a*, conveyance rollers 23, and timing rollers 24.

The pickup rollers 21*a* and 22*a* are each controlled by the controller 40. One of the pickup rollers 21*a* and 22*a* contacts an uppermost recording sheet S in a selected one of the sheet feed cassettes 21 and 22 and feeds the uppermost recording sheet S to a conveyance path 25.

The conveyance rollers 23 convey the recording sheet S picked up by the pickup roller 21*a* or 22*a* towards the timing rollers 24. The timing rollers 24 convey the recording sheet S towards a downstream side of the conveyance path 25 at a timing that is instructed by the controller 40.

The color toner image that is transferred onto the intermediate transfer belt 13 in the image forming section 10 is moved to a secondary transfer position 15*a* by circulating travel of the intermediate transfer belt 13. The secondary transfer position 15*a* is a position at which the intermediate transfer belt 13 and secondary transfer rollers 15 contact each other.

The recording sheet S is conveyed by the timing rollers 24 of the sheet feed section 20 along the conveyance path 25 in accordance with movement of the toner image on the intermediate transfer belt 13. When the recording sheet S passes through the secondary transfer position 15*a*, the color toner image on the intermediate transfer belt 13 is transferred onto the recording sheet S by the secondary transfer rollers 15. The recording sheet S that has passed the secondary transfer position 15*a* is conveyed to the fixing device 30.

The fixing device 30 causes the recording sheet S that is conveyed by the secondary transfer rollers 15 along a direction indicated by arrow D (sheet conveyance direction) to pass through a fixing nip 3, and heats and pressurizes the recording sheet S to fix the color toner image (unfixed image) onto the recording sheet S.

The recording sheet S that has passed through the fixing device 30 is ejected outside the printer 1 by ejection rollers 26 and is stored on an ejection tray 27.

(2) Structure of Fixing Device

Figure 2:
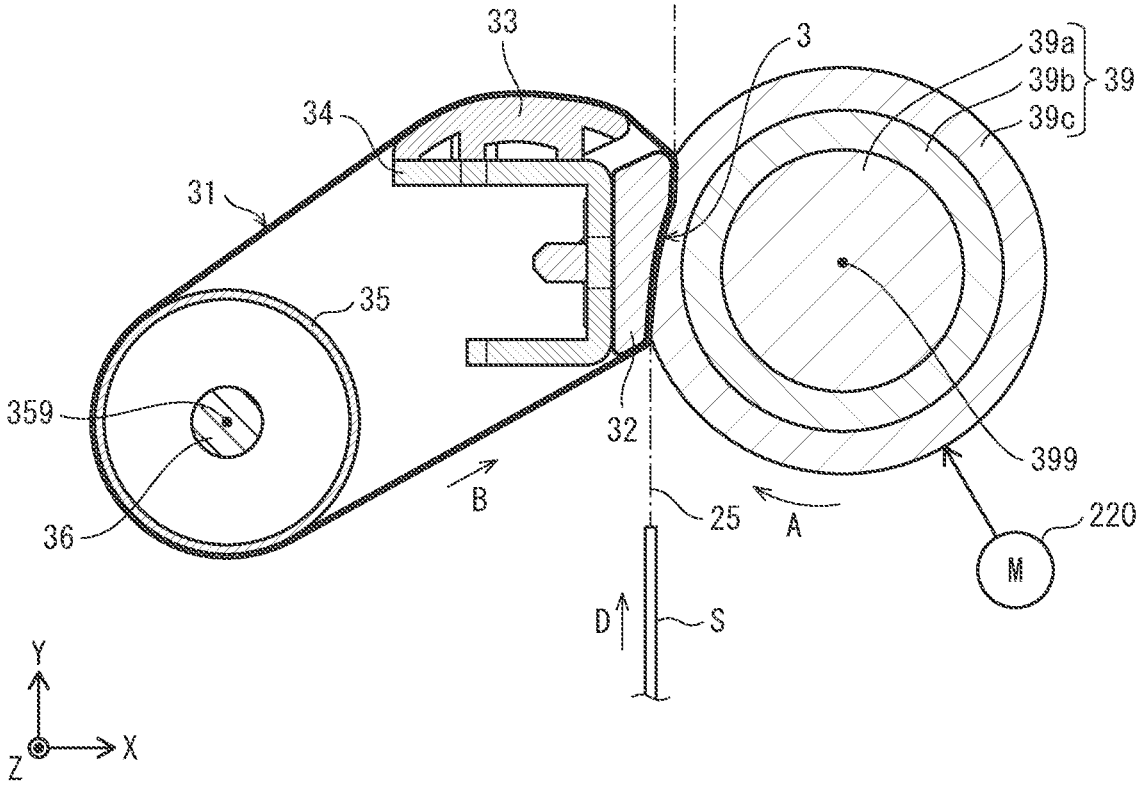
FIG. 2 is a schematic cross-sectional diagram of a basic structure of a fixing device in the printer.

FIG. 2 is a schematic cross-sectional diagram of the structure of main components of the fixing device 30. Here, an X-axis direction is a direction from left to right when the printer 1 is seen from the front, and a Y-axis direction is an upwards direction. A Z-axis direction is a direction orthogonal to both the X-axis direction and the Y-axis direction, and corresponds to a direction from the back to the front of the printer 1. FIG. 2 is a cross-sectional diagram of the fixing device 30 taken along an X-Y plane orthogonal to the Z-axis.

In FIG. 2, the fixing device 30 includes an endless fixing belt 31, a pressure pad 32 that contacts an inner circumferential surface of the fixing belt 31, a guiding member 33 that contacts the inner circumferential surface of the fixing belt 31 and guides the fixing belt 31, a supporting member 34 that supports the pressure pad 32 and the guiding member 33, a heating roller 35 that heats the fixing belt 31, a heater 36 that applies heat to the heating roller 35, and a pressure roller 39 that presses against an outer circumferential surface of the fixing belt 31.

The fixing belt 31 is wrapped around the pressure pad 32, the heating roller 35, and the guiding member 33. As described below, due to the heating roller 35 being biased in a direction away from the pressure pad 32 by an elastic member such as a compression spring, a constant tension is applied to the fixing belt 31.

The fixing belt 31 includes a base layer, and further includes an elastic layer and a release layer that are disposed on the base layer in this order. The base layer is made of polyimide, stainless steel (SUS), nickel (Ni) electroforming or the like. The elastic layer is made of material having great heat resistance such as silicone rubber, fluororubber, or the like. The release layer is a layer to which release characteristics are imparted, such as a fluorine tube, a layer formed through fluorine coating, or the like.

The pressure roller 39 includes a solid core metal 39*a* made of aluminum, iron, or the like, and further includes an elastic layer 39*b* and a release layer 39*c* that are disposed around the core metal 39*a* in this order. The elastic layer 39*b* is made of material having great heat resistance such as silicone rubber, fluororubber, or the like. The release layer 39*c* is a layer to which release characteristics are imparted, such as a fluorine tube, fluorine coating, or the like.

The pressure roller 39 has a rotational axis 399 that is parallel to the Z-axis, and the pressure roller 39 is held by the pressure contact state switching mechanism described later in order for the pressure roller 39 to be in pressure contact with the fixing belt 31 or to be spaced away from the fixing belt 31. FIG. 2 illustrates a state in which the pressure roller 39 is in pressure contact with the fixing belt 31.

The pressure roller 39 is rotationally driven in a direction indicated by arrow A at a defined rotational speed by a rotary driving force of a fixing-conveyance motor 220. Due to the rotation of the pressure roller 39, the fixing belt 31 is driven to rotate (travel) in a direction indicated by arrow B (belt travel direction). Note that the core metal 39*a* is not limited to a solid core metal, and may be, for example, a pipe made of metal.

The pressure pad 32 and the guiding member 33 are arranged adjacent to each other along the belt travel direction, are each a non-rotational body that does not rotate in accordance with the travelling fixing belt 31, and each have a length in the Z-axis direction substantially the same as a Z-axis length (belt width) of the fixing belt 31.

The pressure pad 32 is disposed on an opposite side of the fixing belt 31 from the pressure roller 39 outside the fixing belt 31 and receives a pressing force from the pressure roller 39. Due to this, an outer circumferential surface of the pressure roller 39 comes to be in pressure contact with the outer circumferential surface of the fixing belt 31, and the fixing nip 3 is formed between the fixing belt 31 and the pressure roller 39.

The guiding member 33 is disposed at a position that is downstream of the pressure pad 32 and upstream of the heating roller 35 in the belt travel direction and that is closer to the pressure pad 32 than the heating roller 35. The guiding member 33 guides a portion of the fixing belt 31 that has just passed the fixing nip 3 further downstream in the belt travel direction.

The guiding member 33 is provided in order for a circulation path of the fixing belt 31, which is wrapped around and tensioned between the pressure pad 32 that is a non-rotational body and the heating roller 35 that is a rotational body, to have a smoothly curved shape.

Here, the pressure pad 32 and the guiding member 33 are made of the same material. For example, the pressure pad 32 and the guiding member 33 are made of resin such as polyphenylene sulfide, polyimide, liquid crystal polymer, or the like, and the material for the pressure pad 32 and the guiding member 33 beneficially has great heat resistance. Further, the pressure pad 32 and the guiding member 33 may be made of ceramic, metal such as aluminum or iron, or the like, or may be such material combined with silicone rubber, fluororubber, or the like. Further, the pressure pad 32 and the guiding member 33 may be made of materials differing from each other.

The supporting member 34 is a member having a substantially square-bracket cross-sectional shape and is made of metal such as aluminum, iron, or SUS, and secures and supports the pressure pad 32 and the guiding member 33.

In order to suppress abrasion caused by the inner circumferential surface of the fixing belt 31 sliding on the pressure pad 32 and the guiding member 33, it is beneficial to take a measure for suppressing abrasion. For example, surfaces of portions of the pressure pad 32 and the guiding member 33 that come into contact with the inner circumferential surface of the fixing belt 31 may be coated by using low-friction material such as fluorine resin, or the guiding member 33 may be provided with a lubricant application member that applies lubricant to the inner circumferential surface of the fixing belt 31. For the lubricant application member, material suitable for holding lubricant, e.g. fiber-like material such as aramid fiber or fluorine fiber, or porous material such as a silicone sponge is used. Further, silicone or fluorine lubricant is used for the lubricant, but use of other materials is possible.

(3) Pressure Contact State Switching Mechanism

Figure 3A:
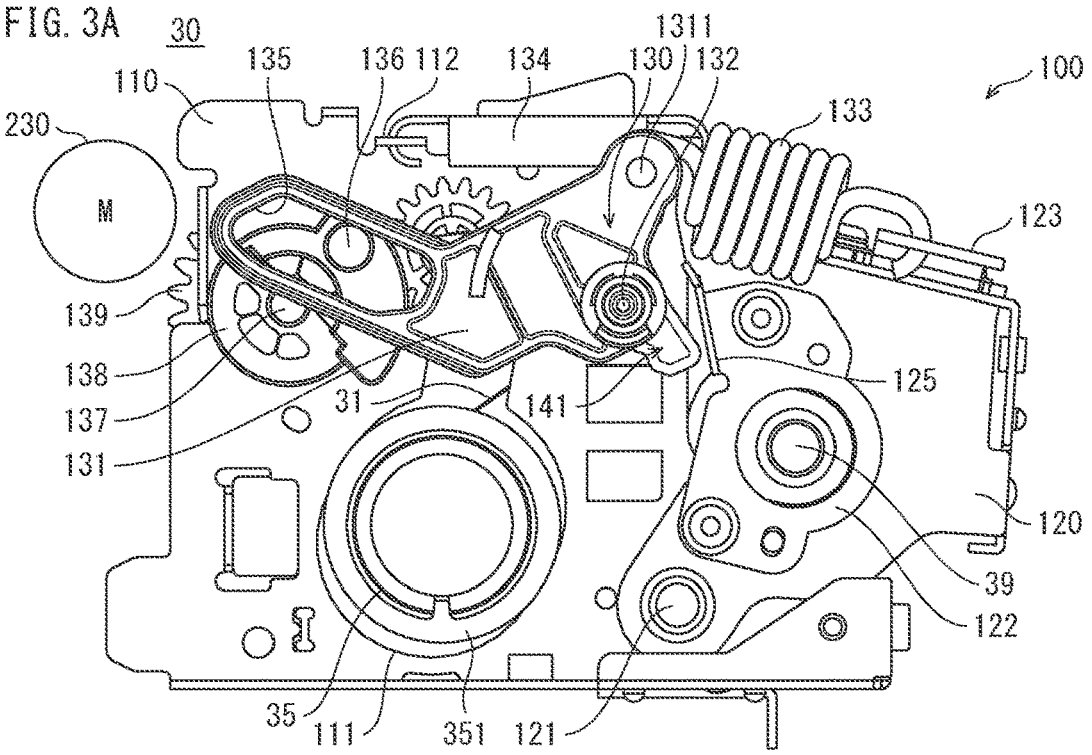
FIG. 3A is a diagram of an overall structure of the fixing device including a pressure contact state switching mechanism.

FIG. 3A is an overall diagram of the fixing device 30 including a pressure contact state switching mechanism 100 switching a contact state of the pressure roller 39 relative to the fixing belt 31.

The heating roller 35 is supported by a main frame (first holding member) 110 through a ring-shaped bearing member 351 to be rotatable about the bearing member 351. The bearing member 351 has a boss portion extending towards the back of the main frame 110 in an axial direction of the bearing member 351, and the boss portion is inserted into an oval hole 111 (see FIG. 4) of the main frame 110.

The oval hole 111 is slightly inclined towards the pressure roller 39. When the bearing member 351 is biased downwards by an elastic member that is not illustrated, such as a compression spring, a force causing a rotational axis 359 of the heating roller 35 to move away from the pressure pad 32 (FIG. 2) is applied. Consequently, a constant tension is applied to the fixing belt 31, which is tensioned between the heating roller 35 and the pressure pad 32.

Further, the main frame 110 supports a sub frame (second holding member) 120 through a support shaft (first support shaft) 121 in order for the sub frame 120 to be swingable in a plane parallel to a main surface of the main frame 110. The sub frame 120 supports the pressure roller 39 through a holding plate 122, and the pressure contact state of the fixing belt 31 and the pressure roller 39 is switched by changing an angle of the sub frame 120 relative to the main frame 110 (hereinafter referred to as "swing angle"). Note that the holding plate 122 may be integrally formed with the sub frame 120.

The pressure contact state switching mechanism 100 is a mechanism for selectively switching the pressure contact state between three states, namely a full pressure contact state, a light pressure contact state, and a release state. The pressure contact state switching mechanism 100 includes a first switcher 130 that directly switches the pressure contact state between the full pressure contact state and the light pressure contact state without switching the pressure contact state to the release state and a second switcher 140 (FIG. 3B) that switches the pressure contact state between the light pressure contact state and the release state.

<Structure of First Switcher 130>

In FIG. 3A, the first switcher 130 includes, as main components, a swing frame 131 that is supported by the main frame 110 through a swing shaft 132 to be swingable about the swing shaft 132, a tension spring (second elastic member) 133 for full pressure contact, a tension spring (first elastic member) 134 for light pressure contact, and a drive disc 138 that is connected to an end of a drive rod (drive shaft) 137 passing through an axial hole of the main frame 110 and protruding towards the front of the printer.

A drive pin 136 standing on the drive disc 138 is inserted into a slot 135 of the swing frame 131 to form a crank mechanism (driving force conversion mechanism).

A pinion (not illustrated) attached to a motor shaft of a pressure contact state switching motor 230 meshes with a spur gear 139, and a rotary force of the pressure contact state switching motor 230 is transmitted through the drive rod (drive shaft) 137 to the drive disc 138. When the drive disc 138 rotates, the swing frame 131 swings about the swing shaft 132 in the up-down direction of the printer 1 due to a crank function described above.

Note that the driving force conversion mechanism is not limited to the crank mechanism as described above, and a different known link mechanism or the like can be used.

Figure 4:
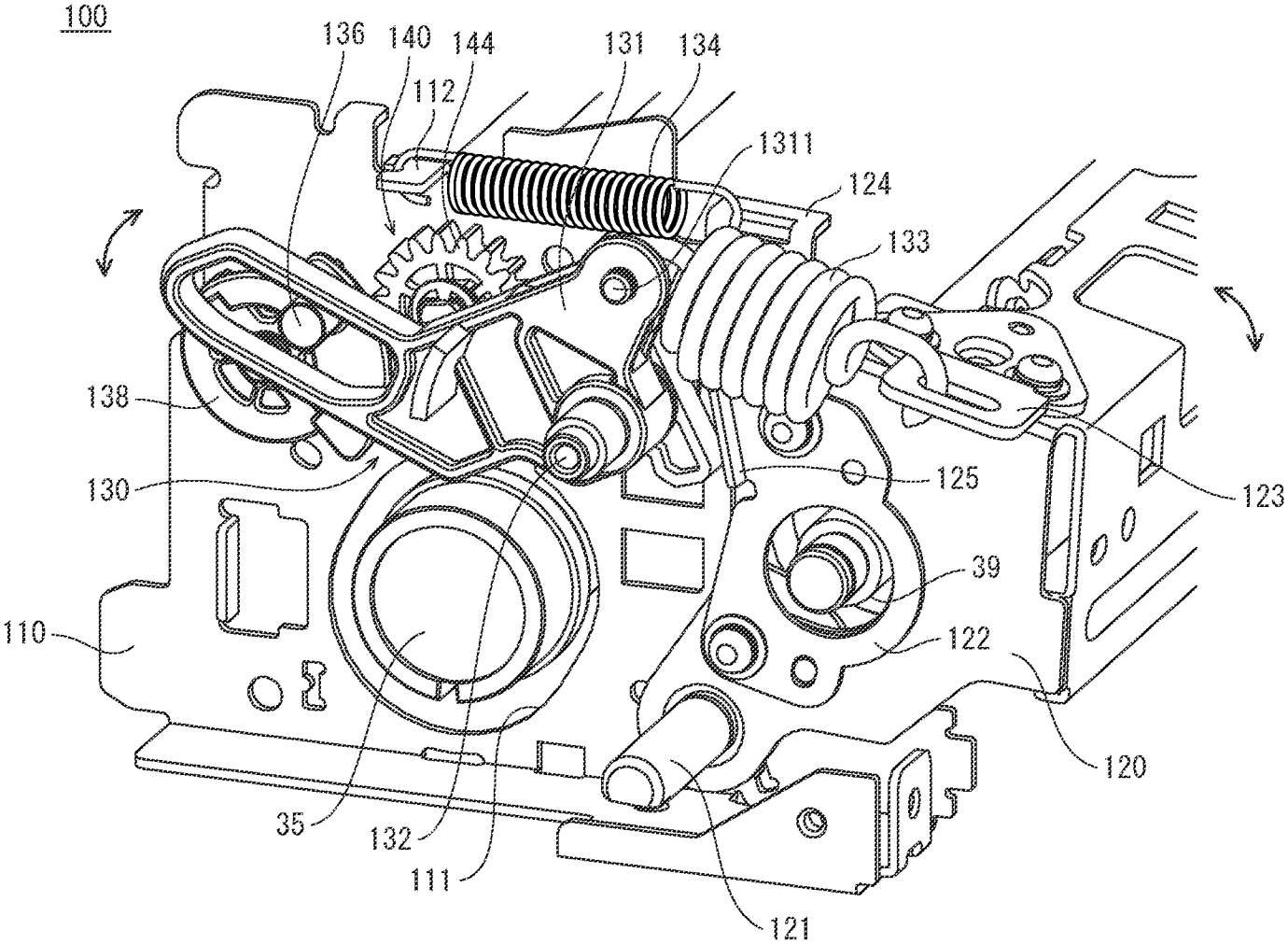
FIG. 4 is a perspective diagram of a structure of the front of the pressure contact state switching mechanism of the fixing device.

FIG. 4 is a schematic perspective diagram at an angle from the front side of the fixing device 30. In FIG. 4, in order to clearly illustrate the shape of the oval hole 111, the bearing member 351 of the heating roller 35 is not illustrated.

Figure 5:
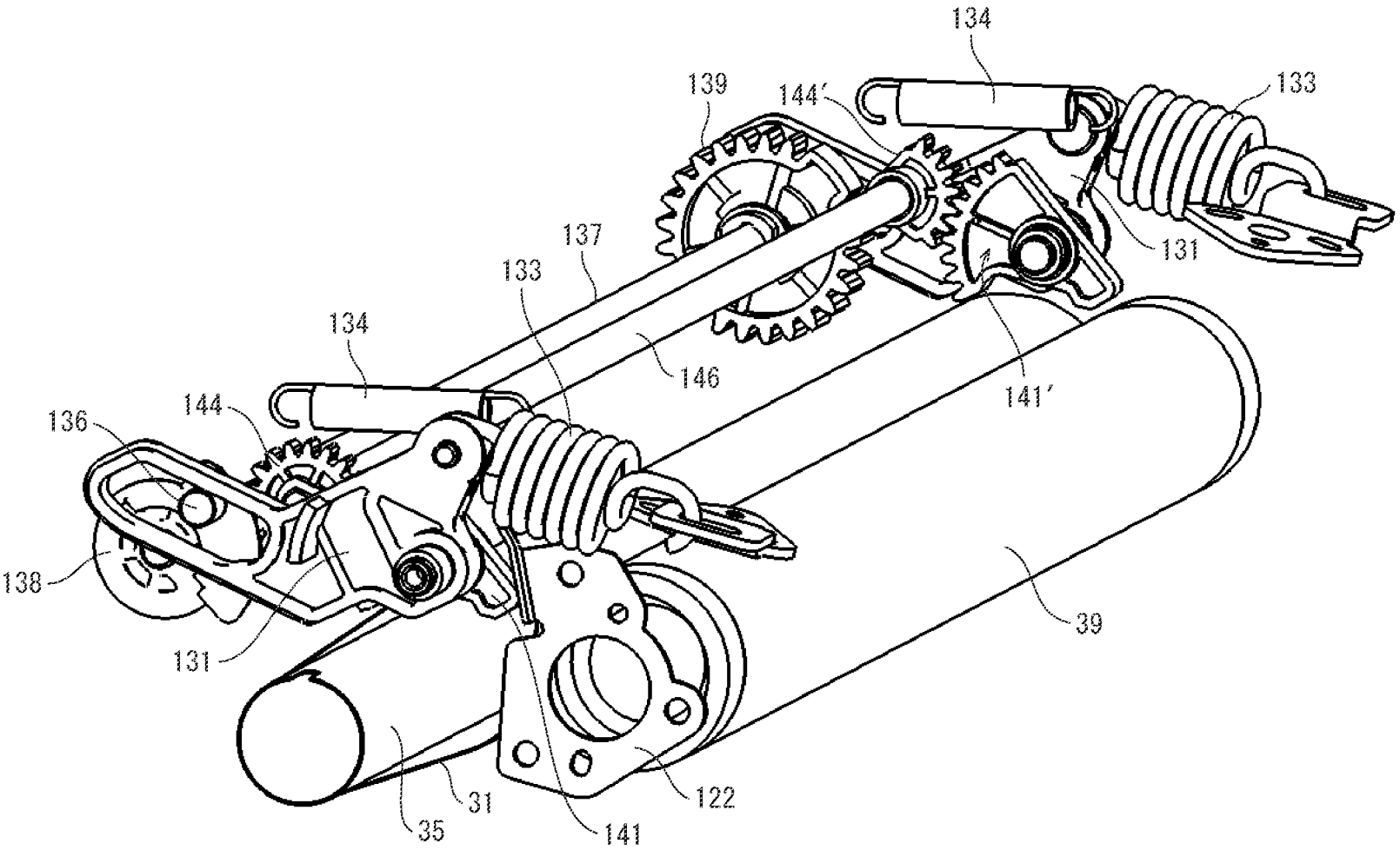
FIG. 5 is a schematic perspective diagram of an overall structure of the fixing device including the pressure contact state switching mechanism.

FIG. 5 is a schematic perspective diagram of an overall structure of the fixing device 30, and the main frame 110 and the sub frame 120 are not illustrated.

In FIG. 4, the tension spring 133 is suspended between a spring hooking portion 123 at an upper portion of the sub frame 120 and a spring hooking pin 1311 at an opposite side of the swing frame 131 from the slot 135.

A distance between the spring hooking portion 123 and the spring hooking pin 1311 changes in accordance with swinging movement of the swing frame 131. Due to this, a biasing force of the tension spring 133 changes, and consequently a pressure contact force between the pressure roller 39 and the fixing belt 31 changes.

The tension spring 134 is suspended between a spring hooking portion 112 at an upper portion of the main frame 110 and a spring hooking portion 124 at the upper portion of the sub frame 120.

<Pressure Contact State Switching Operation by First Switcher 130>

(Light Pressure Contact State)

Figure 6:
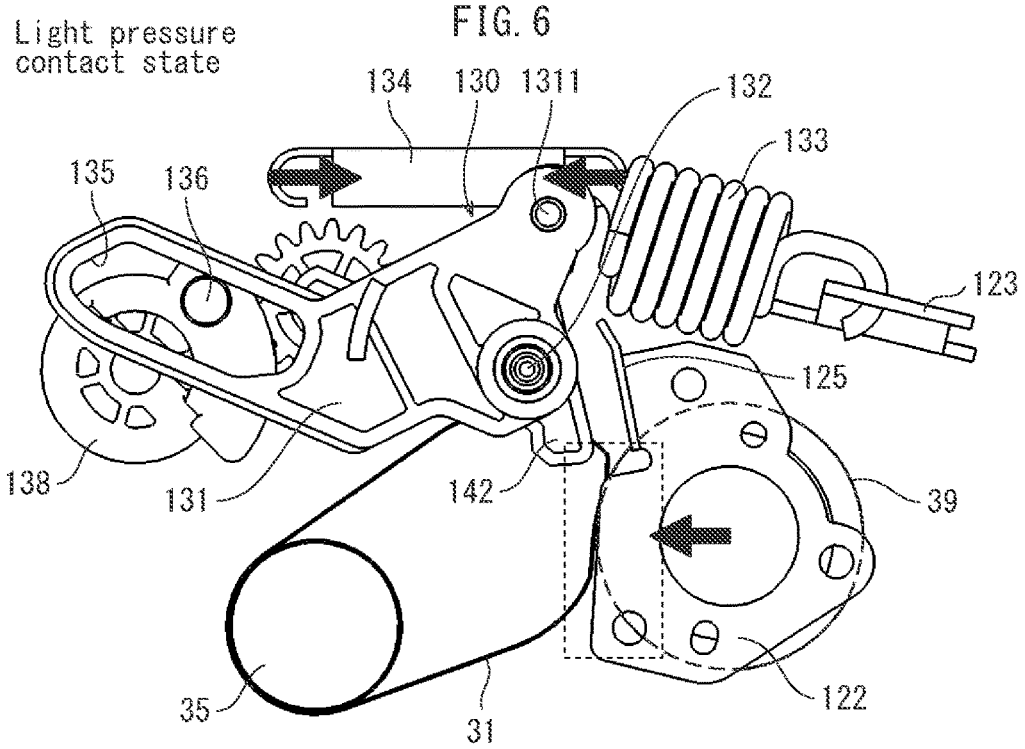
FIG. 6 is a schematic diagram of the fixing device that is switched to a light pressure contact state by the pressure contact state switching mechanism.

FIG. 6 is a schematic diagram of the fixing device 30 when in the light pressure contact state due to the first switcher 130. Here, for convenience of description, the main frame 110 and the sub frame 120 are not illustrated (the rotational position of the drive disc 138 here is referred to as "first rotational position").

In FIG. 6, in the light pressure contact state, the drive pin 136 of the drive disc 138 pushes a portion of the swing frame 131 corresponding to the slot 135 upwards and causes the swing frame 131 to swing clockwise. Here, the spring hooking pin 1311 of the swing frame 131 approaches the sub frame 120 (first swing position), and therefore the tension spring 133 for full pressure contact is at its natural length and does not exert a biasing force.

However, the sub frame 120 is biased towards the main frame 110 by a biasing force of the tension spring 134 for light pressure contact, and therefore the pressure contact state is switched to the light pressure contact state.

(Full Pressure Contact State)

Figure 7:
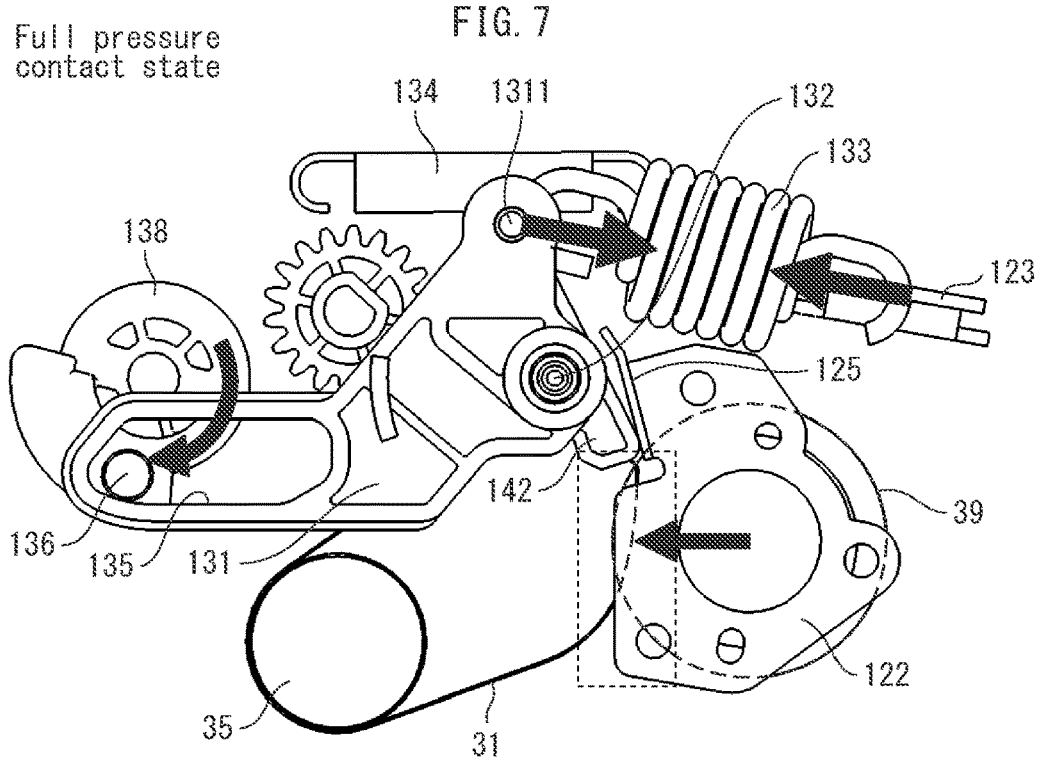
FIG. 7 is a schematic diagram of the fixing device that is switched to a full pressure contact state by the pressure contact state switching mechanism.

The drive disc 138 is rotated clockwise from the state in FIG. 6, and is stopped when reaching a rotational position in FIG. 7 (second rotational position).

Here, the swing frame 131 rotates to the left (counterclockwise) due to the crank function (second swing position), and therefore the spring hooking pin 1311 moves away from the spring hooking portion 123 and the tension spring 133 extends from the natural length. Consequently, the tension spring 133 biases the sub frame 120. The tension spring 133 has a greater spring constant than the tension spring 134, and therefore the sub frame 120 has a swing angle smaller than the swing angle illustrated in FIG. 6.

Accordingly, a distance between the spring hooking portion 112 (FIG. 4) of the main frame 110 and the spring hooking portion 124 of the sub frame 120, between which the tension spring 134 is suspended, becomes shorter. Consequently, the tension spring 134 returns to its natural length and does not bias the sub frame 120.

That is, in the state of FIG. 7, only the tension spring 133 for full pressure contact functions, and the tension spring 134 for light pressure contact does not affect the pressure contact force. Consequently, the full pressure contact state is maintained.

When switching back from the full pressure contact state to the light pressure contact state, the drive disc 138 is rotated counterclockwise from the state of FIG. 7 in order for the drive disc 138 to come to the position in FIG. 6.

As described above, the first switcher 130 is configured to cause the drive disc 138 to rotate in a defined direction to switch the rotational position of the drive disc 138 between the first rotational position in FIG. 6 and the second rotational position in FIG. 7 in order to directly switch the pressure contact state between the light pressure contact state and the full pressure contact state without switching the pressure contact state to the release state. This achieves prompt switching between the light pressure contact state and the full pressure contact state.

Accordingly, during print jobs, when, for example, switching from a job of printing on an envelope to a job of printing on plain paper, switching of the pressure contact state from the light pressure contact state to the full pressure contact state is performed smoothly and therefore the Fcot required before the start of the forthcoming job becomes shorter.

Further, only the tension spring 134 for light pressure contact exerts a restoring force when in the light pressure contact state, and only the tension spring 133 for full pressure contact exerts a restoring force when in the full pressure contact state. Accordingly, by appropriately selecting the spring constant of the tension spring 134, the pressure contact force in the light pressure contact state is stably maintained at a desired value; and by appropriately selecting the spring constant of the tension spring 133, the pressure contact force in the full pressure contact state is stably maintained at a desired value.

<Structure of Second Switcher 140>

Description is provided of the structure of the second switcher 140 for switching the pressure contact state from the light pressure contact state to the release state.

Figure 3B:
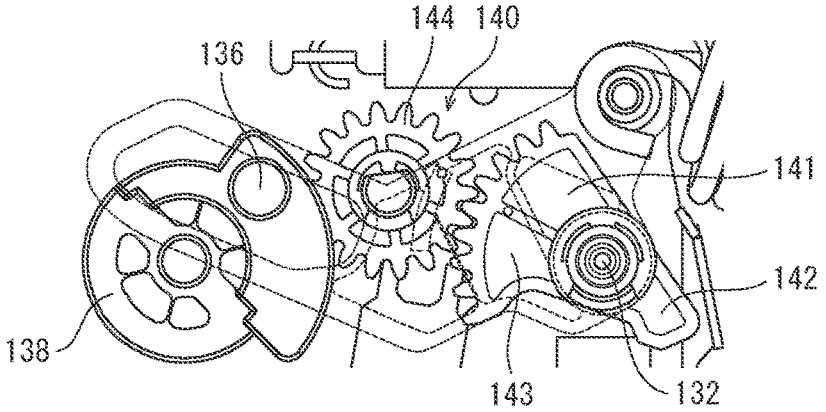
FIG. 3B and FIG. 3C are diagrams for describing a structure of a second switcher of the pressure contact state switching mechanism.

FIG. 3B is an enlarged partial diagram of FIG. 3A seen through the swing frame 131.

In FIG. 3B, main components of the second switcher 140 are a cam member 141 for spacing, an intermediate gear 144, and an intermittent gear 145 (see FIG. 3C) of the drive disc 138 described above.

The cam member 141 is supported by the swing shaft 132, which is the swing shaft of the swing frame 131, and includes: a protruding cam portion 142 protruding towards the sub frame 120; and a partial gear 143 at an opposite side of the cam member 141 from the protruding cam portion 142. The cam member 141 as a whole has a shape resembling a fan.

Figure 3C:
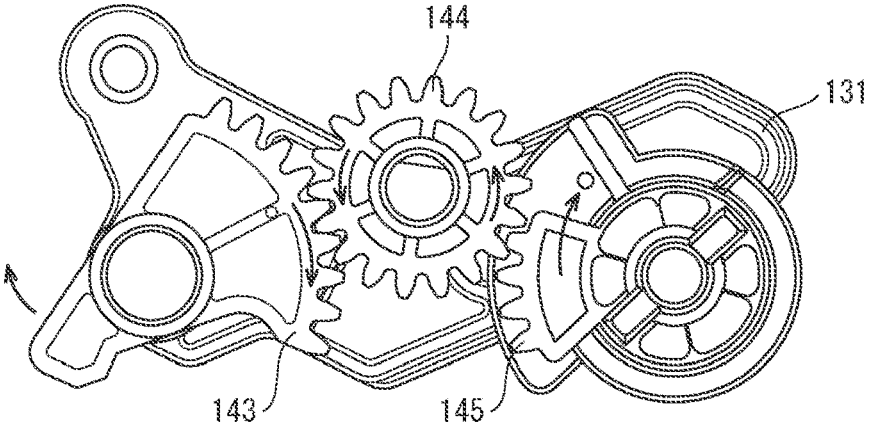

FIG. 3C is a schematic rear-view diagram of the structure in FIG. 3B, showing how the partial gear 143, the intermediate gear 144, and the intermittent gear 145 mesh with one another.

In FIG. 3C, the intermittent gear 145 meshes with the intermediate gear 144 and transmits a rotary force only while the drive disc 138 is at a defined range of rotation. The rotary force transmitted to the intermediate gear 144 is further transmitted to the partial gear 143 and causes the cam member 141 to swing (intermittent transmission mechanism).

<Pressure Contact State Switching Operation by Second Switcher 140>

Description is provided of operations when the pressure contact state is switched from the light pressure contact state in FIG. 6 to the release state (separated state) by the second switcher 140 described above.

Figure 8A:
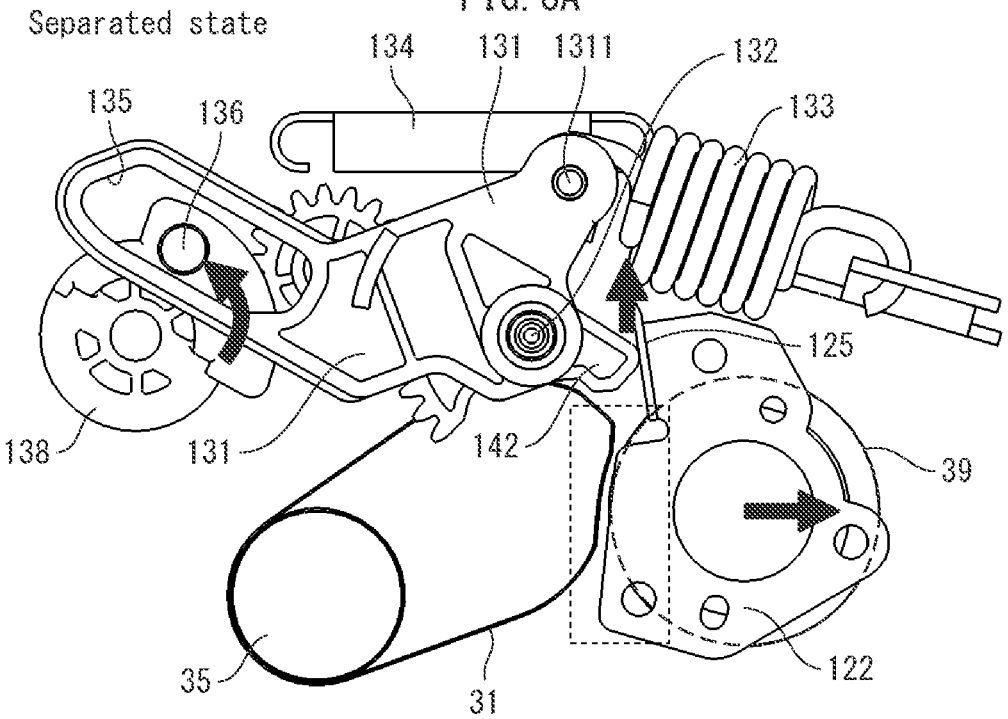
FIG. 8A and FIG. 8B are schematic diagrams of the fixing device that is switched to a separated state by the pressure contact state switching mechanism.
Figure 8B:
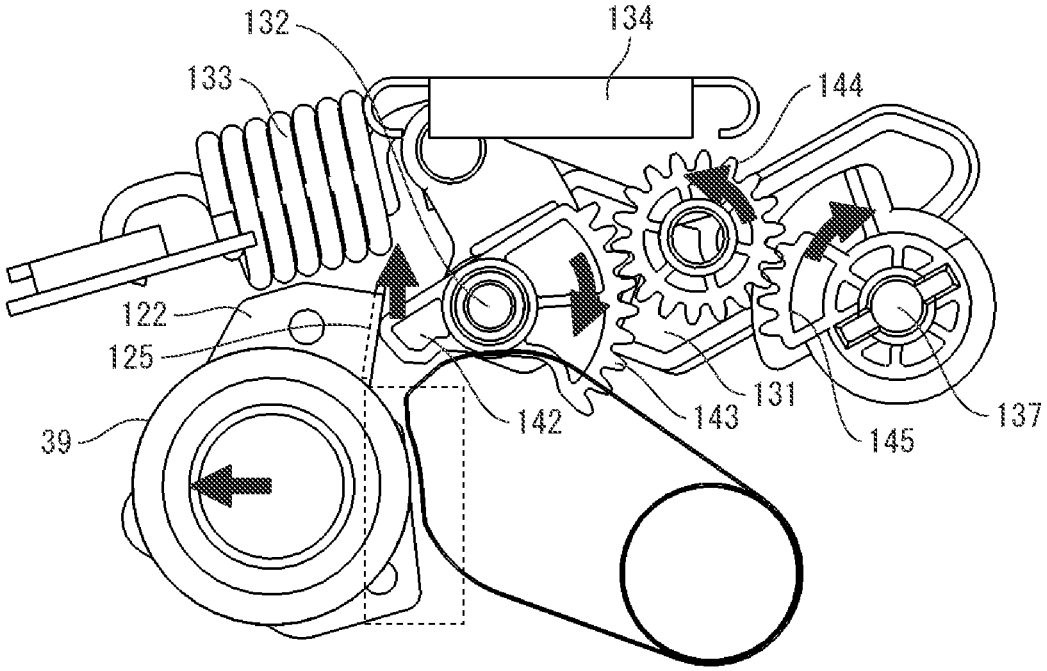

FIG. 8A is a schematic diagram of the fixing device 30 in the release state, seen from the front thereof as in FIG. 6 and FIG. 7, and FIG. 8B is a schematic rear-view diagram of the structure in FIG. 8A.

When the drive disc 138 is caused to rotate counterclockwise as in FIG. 8A from the light pressure contact state in FIG. 6 to the third rotational position, the intermittent gear 145 of the drive disc 138 (see FIG. 8B) meshes with the intermediate gear 144, and a rotary force is transmitted through the intermediate gear 144 and the partial gear 143 of the cam member 141 in order for the protruding cam portion 142 of the cam member 141 to swing upwards.

Due to this, a tip of the protruding cam portion 142 abuts against an abutting member 125 of the holding plate 122 of the sub frame 120 and pushes back the abutting member 125 against the biasing force of the tension spring 134. Due to this, the swing angle of the sub frame 120 becomes greater, the fixing belt 31 and the pressure roller 39 are spaced apart, and the pressure contact state is switched to the release state.

The width of the slot 135 of the swing frame 131 is much greater than the diameter of the drive pin 136 and has play around the drive pin 136. Accordingly, even when the swing angle of the sub frame 120 is greater than necessary when switching to the release state, the swing frame 131 merely swings clockwise in accordance with the movement of the sub frame 120 to a small extent. Consequently, the tension spring 133 remains at the natural length and does not exert a biasing force.

Further, as in the schematic perspective diagram of the overall structure of the fixing device 30 of FIG. 5, at the back of the fixing device 30, another pressure contact state switching mechanism is provided, similar to the pressure contact state switching mechanism at the front of the fixing device 30. Note that the intermittent gear 145 of the drive disc 138 is not provided at the back of the fixing device 30, and the cam member 141' is driven to swing through the intermediate gear 144 at the front of the fixing device 30 and the partial gear 144' at the back of the fixing device 30 connected with a connection rod 146 in order for the cam member 141 and the cam member 141' to swing synchronously.

(4) Structure of Controller

Figure 9:
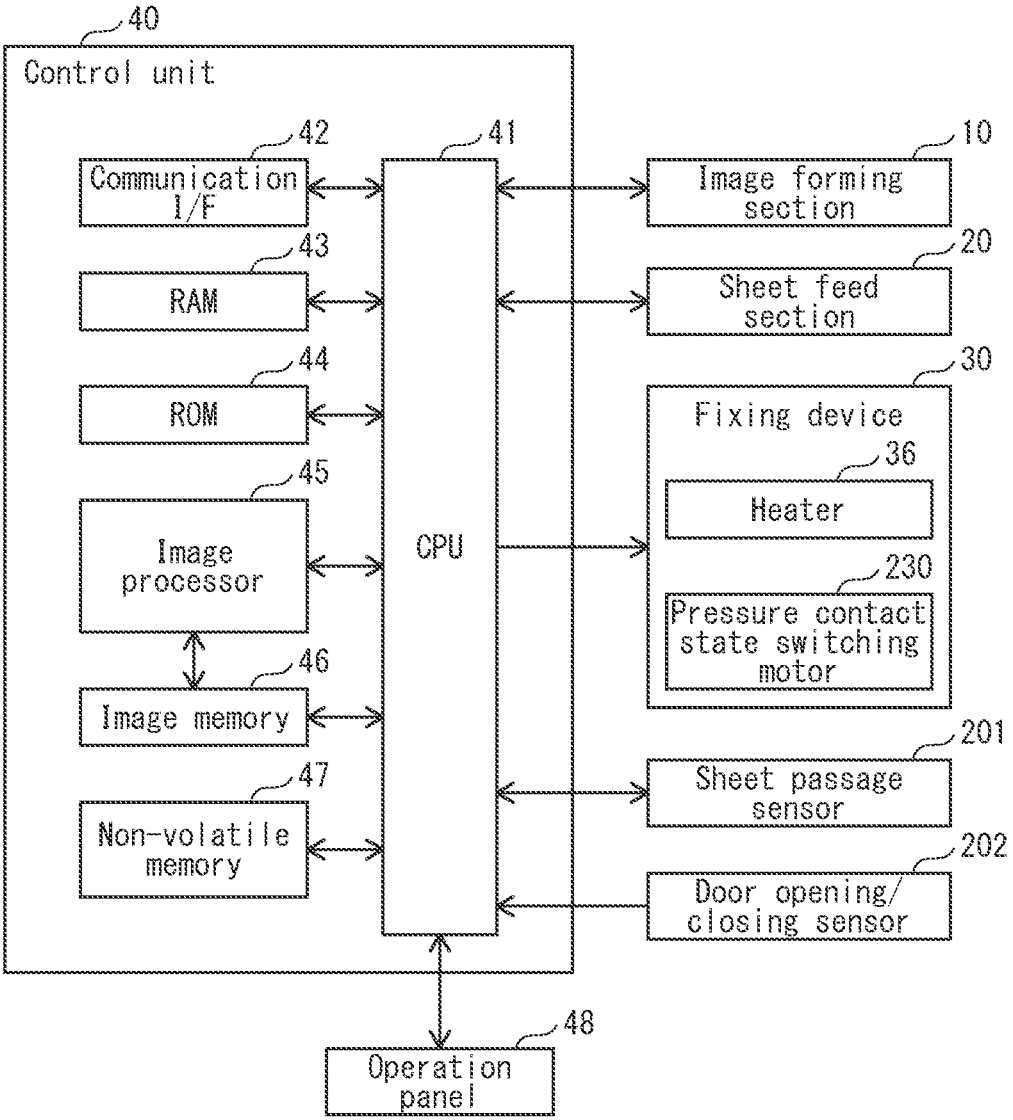
FIG. 9 is a block diagram of a structure of a controller of the printer.

FIG. 9 is a block diagram of the structure of the controller 40 of the printer 1 and a relationship between the controller 40 and other components such as the image forming section 10, the sheet feed section 20, and the fixing device 30.

In FIG. 9, the controller 40 includes components such as a central processing unit (CPU) 41, a communication interface (I/F) 42, a random-access memory (RAM) 43, a read-only memory (ROM) 44, an image processor 45, an image memory 46, and a writable non-volatile memory 47 such as an electrically erasable programmable read-only memory (EEPROM).

When, for example, the printer 1 is booted, the CPU 41 reads out a control program from the ROM 44 and performs the control program while using the RAM 43 as a working memory area.

When a print job is received through the communication I/F 42 from another terminal device connected to a communication network such as a local area network (LAN), the CPU 41 extracts and acquires image data from data of the print job. The acquired image data of red (R), green (G), and blue (B) is converted by the image processor 45 into density data of C, M, Y, and K that are developing colors, is subjected to known image processing such as edge enhancement, smoothing, or the like, and is stored to the image memory 46.

To the non-volatile memory 47, an accumulated value of the number of sheets that have been printed, information indicating the pressure contact state of the fixing device 30, and the like is stored.

An operation panel 48 is disposed at a position in an upper front surface of the printer 1 that is convenient for a user to operate. The operation panel 48 includes components such as a display that is a liquid crystal panel on which a touch panel is laminated. The operation panel 48 is configured to receive an operation instruction from the user and to display various types of messages.

The CPU 41 controls operations of the image forming section 10, the sheet feed section 20, and the fixing device 30 in order for printing operations based on the image data in the image memory 46 described above to be performed smoothly. Further, as necessary, the CPU 41 performs pressure contact state switching processing of switching the pressure contact state of the fixing device 30.

(5) Pressure Contact State Switching Processing

Figure 10:
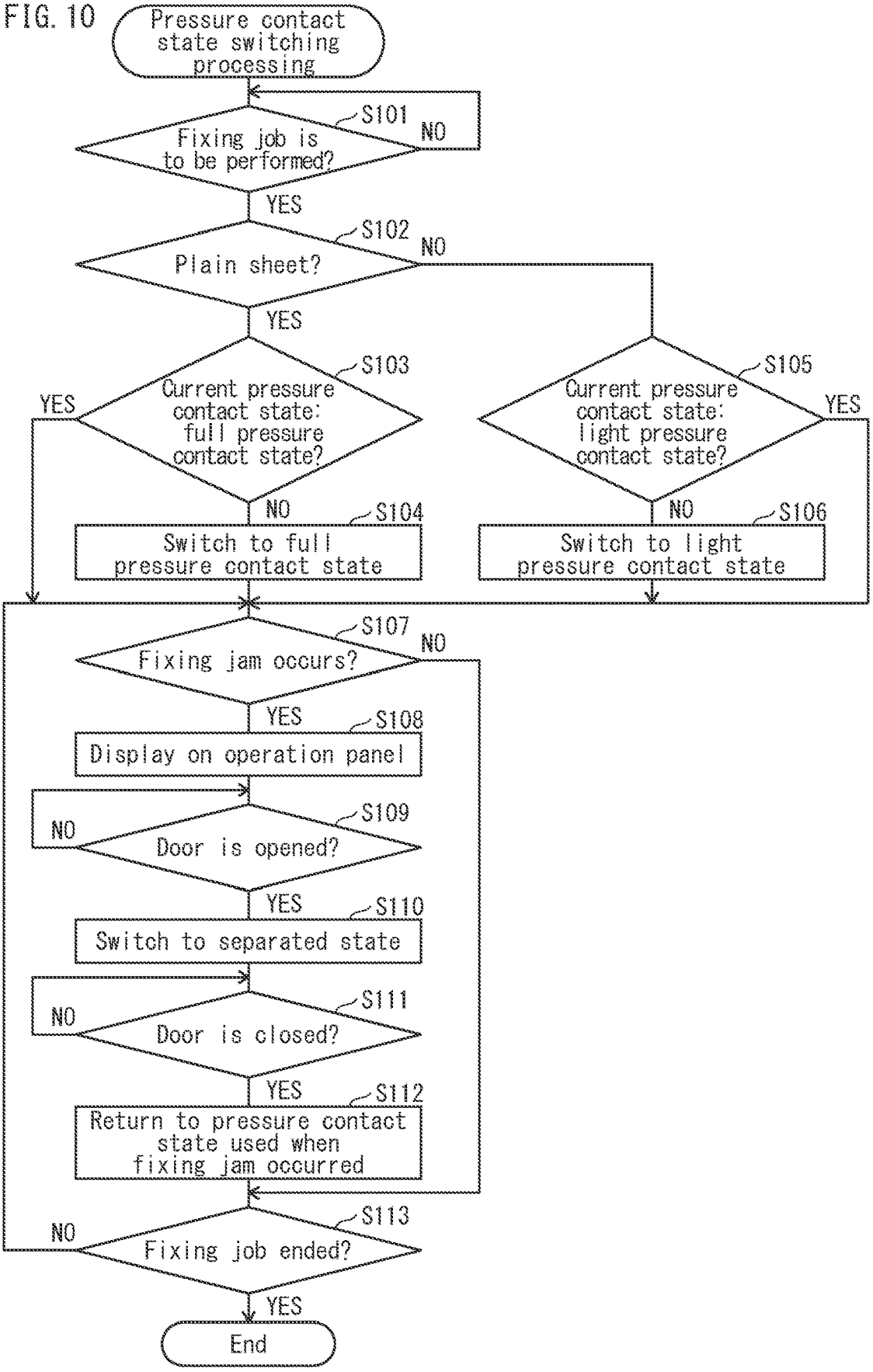
FIG. 10 is a flowchart of procedures of pressure contact state switching processing performed by the controller.

The following describes procedures of the pressure contact state switching processing of the fixing device 30 that the controller 40 performs, with reference to the flowchart of FIG. 10.

First, determination is made of whether or not a fixing job (a job of fixing a toner image on a recording sheet) is to be performed (step S101). This determination is made in accordance with whether or not there is a print job received from the external terminal device through the communication I/F 42.

When the fixing job is to be performed (YES in step S101), determination is made of whether or not fixing is performed for plain paper (step S102).

For example, types of recording sheets (plain paper/special paper) stored in the sheet feed cassettes 21 and 22 are registered in advance to the non-volatile memory 47 by the user or an administrator of the printer 1 through the operation panel 48. When the user issues a print job, the user specifies one of the sheet feed cassettes through the printer driver of the terminal device, and information relating to the specified sheet feed cassette is attached to the header of the print job as control data.

The controller 40 is configured to read out the information relating to the specified sheet feed cassette from the control data of the received print job and determine, based on the read information, whether the target of fixing is plain paper or special paper.

Alternatively, a configuration in which the user directly selects a sheet feed cassette through the operation panel 48 of the printer 1, the selection by the user is stored in the RAM 43 or the like, and the CPU 41 reads out information relating to the selected sheet feed cassette from the RAM 43 is possible.

Note that the non-volatile memory 47 is configured to temporarily store a flag F expressing the current pressure contact state of the fixing device 30 (for example, F=1 when in the light pressure contact state, F=2 when in the full pressure contact state, and F=3 when in the release state).

Further, the current pressure contact state may be detected with use of, for example, a light shielding member that is added to the drive disc 138 to protrude to a radial direction of the drive disc 138 and detection sensors such as photointerrupter-type detection sensors (transmission-type photosensors) disposed at positions corresponding to the first rotational position, the second rotational position, and the third rotational position. When the drive disc 138 is at the first rotational position, the second rotational position, or the third rotational position, the light shielding member described above shields light detected by the corresponding one of the detection sensors. Note that how the pressure contact state is detected is not limited to this. The pressure contact state may be detected by detecting positions to which the swing frame 131 and the cam member 141 swing. Alternatively, when a stepping motor is used for the pressure contact state switching motor 230 for switching the pressure contact state, the current rotational position of the drive disc 138 may be detected by detecting a reference position upon initial booting of the printer 1 with use of a home position sensor and counting drive pulses from the reference position.

When determination is made that the target of the fixing job is plain paper (YES in step S102), determination is made of whether or not the current pressure contact state is the full pressure contact state by referring to the value of the flag F described above (step S103). When not in the full pressure contact state (NO in step S103), determination is made that the target of the preceding fixing job was special paper and the fixing device 30 is in the light pressure contact state. Accordingly, the drive disc 138 is rotated clockwise from the first rotational position in FIG. 6 to the second rotational position in FIG. 7 to switch the pressure contact state to the full pressure contact state (step S104).

Further, when determination is made in step S103 that the current pressure contact state is the full pressure contact state (YES in step S103), step S104 is skipped.

In contrast, when determination is made in step S102 that the target of the fixing job is not plain paper (NO in S102), determination is made of whether or not the current pressure contact state is the light pressure contact state by referring to the value of the flag F described above (step S105). When not in the light pressure contact state (NO in step S105), determination is made that the target of the preceding fixing job was plain paper and the fixing device 30 is in the full pressure contact state. Accordingly, the drive disc 138 is rotated counterclockwise from the second rotational position in FIG. 7 to the first rotational position in FIG. 6 to switch the pressure contact state to the light pressure contact state (step S106).

When a fixing jam (sheet jam that occurs in the fixing device 30, specifically in the nip thereof) occurs during performing the fixing job after setting the pressure contact state in accordance with the sheet type above (YES in S107), the display of the operation panel 48 displays a notification indicating occurrence of the fixing jam (step S108).

Note that determination of whether or not a fixing jam has occurred is made by detecting a conveyance state of the recording sheet by using a sheet passage sensor 201 disposed immediately upstream of the nip of the fixing device 30 in the sheet conveyance direction (see FIG. 1, FIG. 9). That is, the controller 40 determines that a fixing jam has occurred when the sheet passage sensor 201 detects a front edge of a recording sheet and does not detect a rear edge of the recording sheet after an elapse of a defined time period since the detection of the front edge.

When the user opens a door for maintenance for the purpose of dealing with the fixing jam (YES in step S109), the controller 40 drives the pressure contact state switching motor 230 to cause the drive disc 138 to rotate to switch the pressure contact state to the separated state (step S110).

Whether the door is opened or closed is detected by a known door opening/closing sensor 202 (see FIG. 1, FIG. 9). For example, the detection operation is performed by means of a limit switch at a main body of the image forming device. The limit switch is turned on when the door is closed and a protruding member on an inner surface of the door abuts against the limit switch; and the limit switch is turned off when the door is opened.

When the user finishes dealing with the fixing jam and closes the door (YES in step S111), the controller 40 refers to the flag in the non-volatile memory 47 and drives the pressure contact state switching motor 230 in order for the pressure contact state of the fixing device 30 to return to the state before occurrence of the fixing jam (step S112).

When determination that a fixing jam has occurred is not made in step S107 (NO in S107), steps S108 through S112 are skipped.

In the present embodiment, the controller 40 functions as "an acquirer acquiring information relating to which state the pressure contact state is to be switched into" of the present disclosure when the controller 40 performs the determinations of step S102, step S109, or step S111 described above.

Then, determination is made of whether or not the sequence of the fixing job has ended (step S113). When the fixing job has not ended (NO in step S113), the processing returns to step S107 and the controller 40 continues monitoring of occurrence of fixing jams.

When determination is made in step S113 that the fixing job has ended, the pressure contact state switching processing ends.

In the present embodiment, the pressure contact state switching processing ends with the pressure contact state of the fixing device 30 remaining in the pressure contact state used when performing the fixing job. However, from the perspective of durability of the elastic members of the pressure roller 39, a structure in which the pressure contact state returns to the light pressure contact state when the pressure contact state switching processing ends is possible.

(6) Summary of Effects

According to the present embodiment, the pressure contact state switching mechanism 100 for switching the pressure contact state of the fixing device 30 includes the first switcher 130 for switching between the full pressure contact state and the light pressure contact state without switching the pressure contact state to the release state and the second switcher 140 for switching between the light pressure contact state and the release state (separated state). Due to this, when print jobs for different sheet types are performed sequentially, switching of the pressure contact state between the full pressure contact state and the light pressure contact state is performed promptly with use of the first switcher 130. Consequently, the time period required before the output of the first page of the forthcoming print job becomes shorter.

Further, when the pressure contact state of the fixing device 30 needs to be switched to the release state for the purpose of dealing with the fixing jam or the like, the second switcher 140 is driven.

The first switcher 130 and the second switcher 140 are driven independently from each other by controlling, by using the controller 40, the rotational position and a rotational direction of the drive disc 138 that is rotated by a single drive source (pressure contact state switching motor 230). This structure is beneficial in terms of costs.

The first switcher 130 is configured such that only the tension spring 133 contributes to pressure contact when switching to the full pressure contact state and only the tension spring 134 contributes to pressure contact when switching to the light pressure contact state. Accordingly, by appropriately selecting the spring constant of the tension spring 133, the full pressure contact state is stably maintained; and by appropriately selecting the spring constant of the tension spring 134, the light pressure contact state is stably maintained.

Further, the second switcher 140 is configured to switch the pressure contact state from the light pressure contact state, which requires a small biasing force, to the release state. Accordingly, burden of the pressure contact state switching motor 230 when switching from the light pressure contact state to the release state is small.

<Modifications>

Although description of the present disclosure has been provided with reference to an embodiment, the present disclosure should not be construed as being limited to the above embodiment, and for example the following modifications are possible.

(1) In the pressure contact state switching mechanism 100 in the above embodiment, the first switcher 130 and the second switcher 140 are driven by the same drive motor. However, the present disclosure should not be construed as being limited to this, and a drive source used exclusively for the first switcher 130 and a drive source used exclusively for the second switcher 140 may be provided separately.

Figure 11:
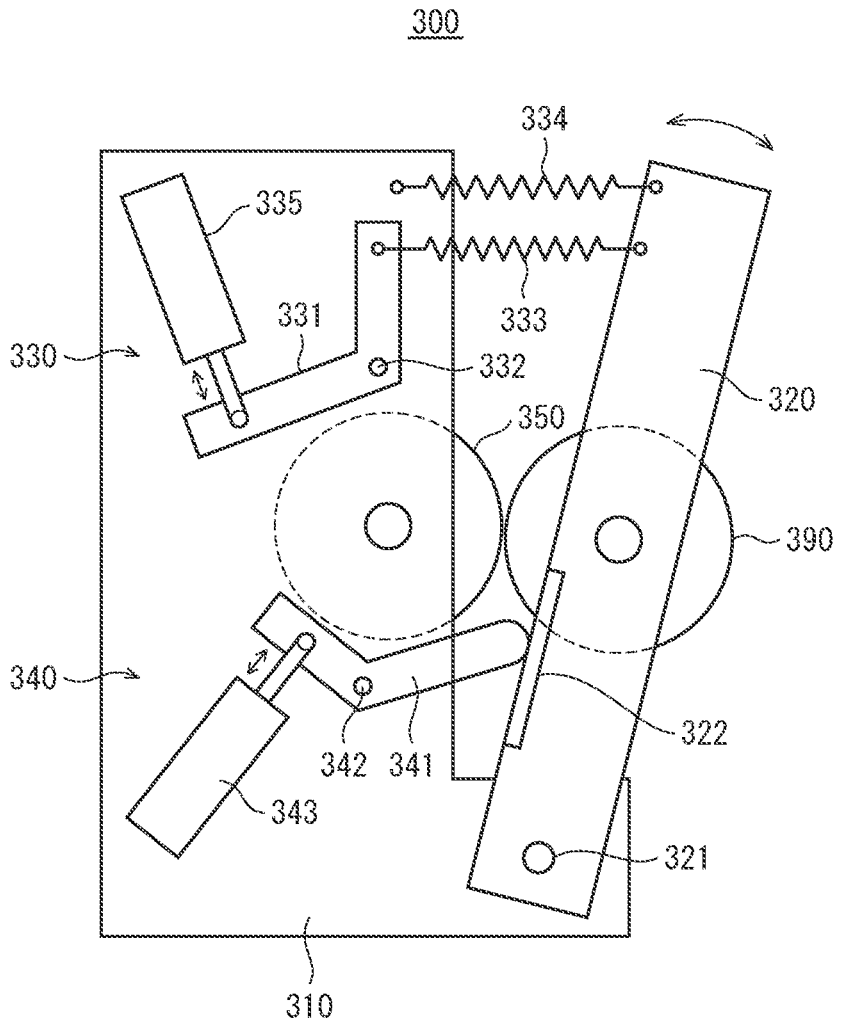
FIG. 11 is a schematic diagram of a modification of the pressure contact state switching mechanism.
Figure 12A:
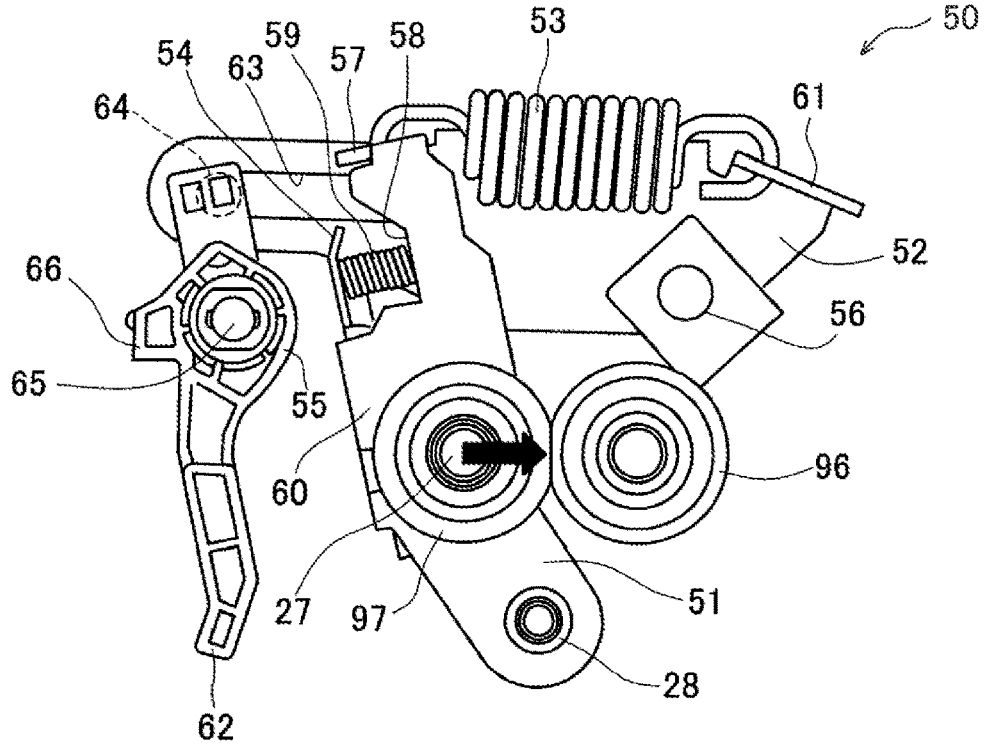
FIG. 12A Prior Art
FIG. 12A is a diagram of a pressure contact state switching mechanism in a conventional fixing device in the full pressure contact state.
Figure 12B:
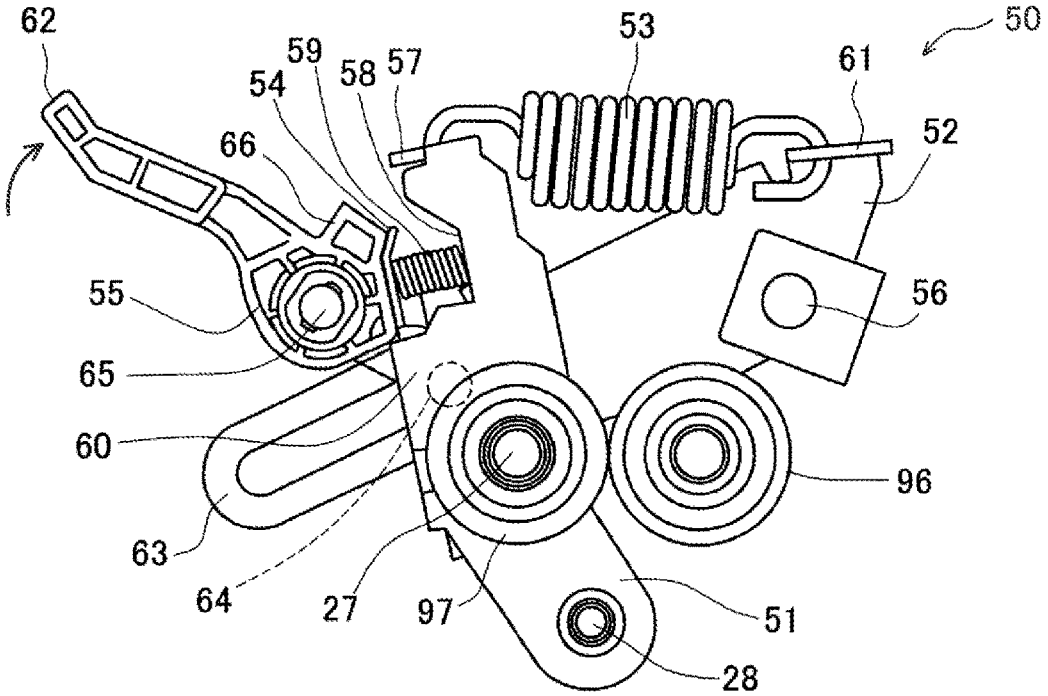
FIG. 12B Prior Art
FIG. 12B is a diagram of the pressure contact state switching mechanism in the conventional fixing device in the separated state.
Figure 13:
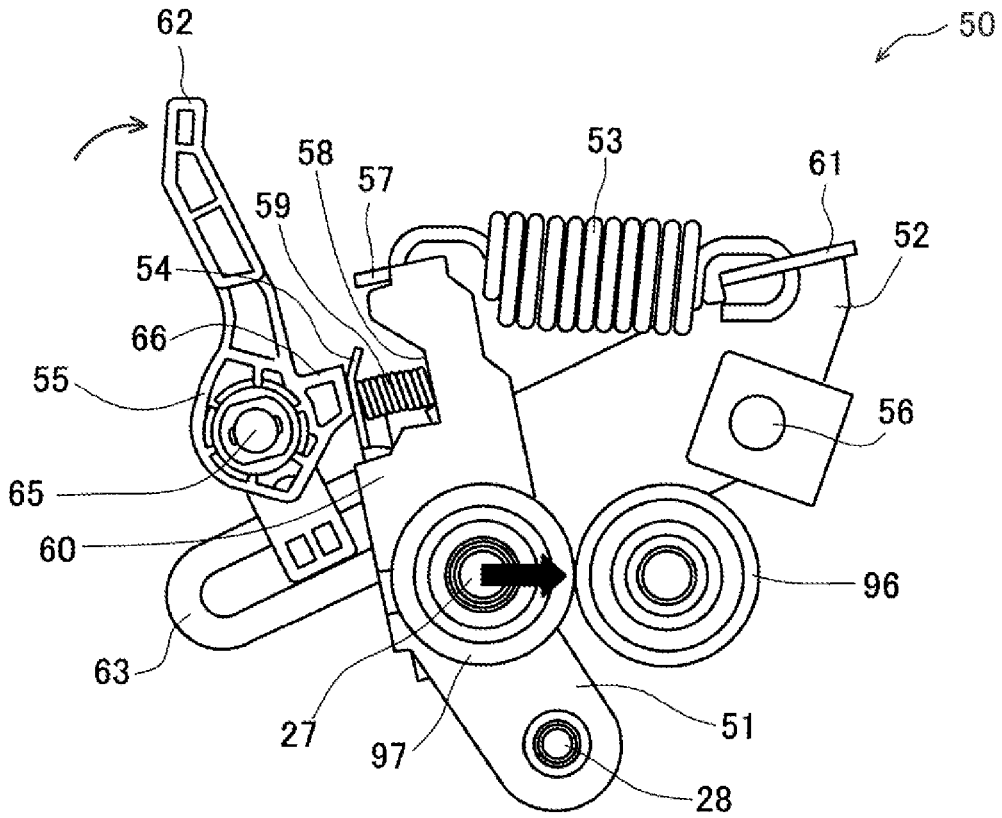
FIG. 13 Prior Art
FIG. 13 is a diagram of the conventional fixing device that is switched to the light pressure contact state by the pressure contact state switching mechanism.

FIG. 11 is a schematic diagram of an example of a pressure contact state switching mechanism 300 pertaining to such a modification.

In FIG. 11, the pressure contact state switching mechanism 300 holds a heating roller 350 such that the heating roller 350 is rotatable relative to a main frame 310, a sub frame 320 is supported by the main frame 310 through a support shaft 321 to be swingable about the support shaft 321, and the sub frame 320 rotatably supports a pressure roller 390.

The pressure contact state switching mechanism 300 includes a first switcher 330 and a second switcher 340.

The first switcher 330 includes a v-shaped swing arm 331, an actuator 335, a tension spring 333, and a tension spring 334. The swing arm 331 is supported by the main frame 310 through a support shaft 332 to be swingable about the support shaft 332. The actuator 335 is a drive source that causes the swing arm 331 to swing. The tension spring 333 is suspended between the sub frame 320 and an end of the swing arm 331 at an opposite side of the swing arm 331 from an end of the swing arm 331 that is driven by the actuator 335. The tension spring 334 is suspended between an upper portion of the main frame 310 and an upper portion of the sub frame 320.

The second switcher 340 includes a v-shaped swing arm 341, an actuator 343, and an abutting member 322. The swing arm 341 is supported by the main frame 310 through the support shaft 342 to be swingable about the support shaft 342. The actuator 343 is a drive source that causes the swing arm 341 to swing. The abutting member 322 is provided to the sub frame 320 and abuts against a tip of the swing arm 341.

FIG. 11 illustrates a state in which the heating roller 350 and the pressure roller 390 are spaced apart. In this state, the actuator 343 is driven to cause the swing arm 341 to swing counterclockwise, thereby causing the pressure roller 390 to be in pressure contact with the heating roller 350.

Here, the tension spring 333 is at its natural length, only a biasing force of the tension spring 334 is applied to the sub frame 320, and the pressure contact state is switched to the light pressure contact state.

When the actuator 335 is driven to cause the swing arm 331 to swing counterclockwise from this state, the tension spring 333 extends from the natural length by a predetermined length, and due to a restoring force of the tension spring 333, the sub frame 320 further approaches the main frame 310. Here, the tension spring 334 is at its natural length, and the pressure roller 390 comes to be in pressure contact with the heating roller 350 only by a biasing force of the tension spring 333. The tension spring 333 has a sufficiently greater spring constant than the tension spring 334, and due to this, the pressure contact state is switched to the full pressure contact state.

The actuator 335 for causing the swing arm 331 to swing and the actuator 343 for causing the swing arm 341 to swing should not be construed as being limited to the above example. The actuator 335 and the actuator 343 each may be a powerful solenoid; further, the actuator 335 and the actuator 343 each may be a hydraulic cylinder or an air cylinder in cases of large-scale industrial printers.

Further, other similar crank mechanisms, link mechanisms, or cam mechanisms may be used in order to cause the swing arm 331 and the swing arm 341 to swing.

(2) In the above embodiment, a single swing shaft 132 serves as both the swing shaft of the swing frame 131 and the swing shaft of the cam member 141, but the present embodiment should not be construed as being limited to this. The swing frame 131 and the cam member 141 may be swingably supported at positions differing from each other as long as the switchers each are configured to achieve the pressure contact state switching operations described above.

(3) In the above embodiment, the sub fame 120 is biased by the tension spring 133 and the tension spring 134 towards the main frame 110. However, the elastic member for biasing should not be construed as being limited to tension springs, and a compression spring, a helical spring, a leaf spring, or the like may be used for the tension spring 133 or the tension spring 134 as required.

(4) In the above embodiment, description is provided of an example in which the fixing belt is tensioned between the heating roller and the pressure pad to form the heating structure. However, a structure in which the fixing roller and the pressure roller directly form the fixing nip without the fixing belt disposed therebetween as in Modification (1) above is possible.

Further, the heat source should not be construed as being limited to a halogen heater, and a system in which a heating layer of the fixing belt is heated through electromagnetic induction with use of an exciting coil or a system in which the fixing belt is heated with use of a resistance heating element is possible.

Also, the pressure structure should not be construed as being limited to a rotational body such as a pressure roller. For example, a longitudinal pressure pad may be used instead of a pressure roller.

In summary, the present disclosure is applicable to any fixing device in which a fixing nip is formed by a heating structure that is heated and a pressure structure that pressurizes the heating structure, a recording sheet is passed through the fixing nip, and fixing is performed.

(5) In the above embodiment, switching of the pressure contact state is achieved with the heating structure being fixed and the pressure structure being caused to move. However, the present disclosure should not be construed as being limited to this, and a structure in which the heating structure is caused to move is possible in some cases.

(6) In the above embodiment, description is provided of a tandem-type color printer. However, the present disclosure should not be construed as being limited to this, and may be an image forming device such as a facsimile, a copier, or a multi-function peripheral (MFP). Alternatively, a monochrome image forming device is possible.

Further, the present disclosure should not be construed as being limited to image forming devices, and may be applicable to a pressure contact state switching device in any device in which a pressure contact state between a first member (first structure) and a second member (second structure) needs to be switched between a first pressure contact state, a second pressure contact state that uses a pressure contact force differing from the pressure contact force used in the first pressure contact state, and a release state in which pressure contact is released.

<<Supplement>>

Although the fixing device and the image forming device pertaining to the present disclosure have been described by way of an embodiment and modifications, it is to be noted that the present disclosure should not be construed as being limited to the above embodiment and modifications. Therefore, various changes and modifications that are apparent to a skilled artisan and one or more embodiments that are achieved through combining elements and functions of embodiments and modifications should be construed as being included therein unless such changes and modifications depart from the scope of the present disclosure.

Although one or more embodiments of the present invention have been described and illustrated in detail, the disclosed embodiments are made for the purposes of illustration and example only and not limitation. The scope of the present invention should be interpreted by the terms of the appended claims.

What is claimed is:

1. A fixing device fixing an unfixed toner image onto a recording sheet by passing the recording sheet through a nip, the fixing device comprising:

a pressure structure and a heating structure that form the nip when in pressure contact with each other; and a pressure contact state switching unit selectively switching a pressure contact state of the heating structure and the pressure structure between a first pressure contact state, a second pressure contact state, and a release state, wherein the pressure contact state switching unit comprises:

a first switcher directly switching the pressure contact state between the first pressure contact state and the second pressure contact state, and vice versa, without switching the pressure contact state to the release state;

a second switcher switching the pressure contact state between the first pressure contact state and the release state;

an acquirer acquiring information relating to which state the pressure contact state is to be switched into; and a controller controlling the first switcher and the second switcher based on the information acquired by the acquirer through driving the first switcher or the second switcher to switch the pressure contact state.

2. The fixing device of claim 1, wherein a pressure contact force between the heating structure and the pressure structure is smaller in the first pressure contact state than in the second pressure contact state.

3. The fixing device of claim 1, wherein the heating structure is a heating roller.

4. The fixing device of claim 1, wherein the heating structure includes a heating roller, a pressure pad, and a fixing belt tensioned between the heating roller and the pressure pad.

5. The fixing device of claim 1, wherein the pressure structure is a pressure roller.

6. The fixing device of claim 1, wherein the heating structure does not move and the pressure structure is moved relative to the heating structure to achieve the switching of the pressure contact state between the first pressure contact state, the second pressure contact state, and the release state.

7. A fixing device fixing an unfixed toner image onto a recording sheet by passing the recording sheet through a nip, the fixing device comprising:

a pressure structure and a heating structure that form the nip when in pressure contact with each other; and a pressure contact state switching unit selectively switching a pressure contact state of the heating structure and the pressure structure between a first pressure contact state, a second pressure contact state, and a release state, wherein the pressure contact state switching unit comprises:

a first switcher directly switching the pressure contact state between the first pressure contact state and the second pressure contact state without switching the pressure contact state to the release state;

a second switcher switching the pressure contact state between the first pressure contact state and the release state;

an acquirer acquiring information relating to which state the pressure contact state is to be switched into; and a controller controlling the first switcher and the second switcher based on the information acquired by the acquirer through driving the first switcher or the second switcher to switch the pressure contact state, wherein the pressure contact state switching unit includes a first elastic member and a second elastic member that has a spring constant differing from a spring constant of the first elastic member, and when the pressure contact state is switched to the first pressure contact state by the first switcher, an elastic force of the first elastic member is exerted and an elastic force of the second elastic member is not exerted, and when the pressure contact state is switched to the second pressure contact state by the first switcher, the elastic force of the first elastic member is not exerted and the elastic force of the second elastic member is exerted.

8. The fixing device of claim 7, wherein a first holding member holding the heating structure supports a second holding member holding the pressure structure through a first support shaft in order for the second holding member to be swingable about the first support shaft, the first switcher includes:

a swing arm supported by the first holding member through a second support shaft to be swingable about the second support shaft; and an arm driver that causes the swing arm to swing between a first swing position and a second swing position, the first elastic member is disposed between the first holding member and the second holding member in order to bias the second holding member towards the first holding member, the second elastic member is disposed between the swing arm and the second holding member, in the first swing position of the swing arm, the second elastic member is at its natural length and the pressure structure being biased by the elastic force of the first elastic member leads the pressure contact state to be in the first pressure contact state, and in the second swing position of the swing arm, the first elastic member is at its natural length and the elastic force of the second elastic member being exerted leads the pressure contact state to be in the second pressure contact state.

9. The fixing device of claim 8, wherein the second switcher includes:

a protruding cam that is supported by the first holding member through a cam shaft to be rotatable about the cam shaft; and a protruding cam driver that causes the protruding cam to rotate, and the protruding cam driver causes the protruding cam to rotate in order for the protruding cam to abut against an abutting portion of the second holding member, thereby causing the second holding member to move away from the first holding member to switch the pressure contact state from the first pressure contact state to the release state.

10. The fixing device of claim 9, wherein the second support shaft serves as the cam shaft.

11. The fixing device of claim 9, further comprising:

a drive source that drives the arm driver and the protruding cam driver.

12. The fixing device of claim 11, wherein the first switcher includes a driving force conversion mechanism that converts a rotary driving force of the drive source to swinging movement of the swing arm, the second switcher includes an intermittent transmission mechanism that, through an intermittent gear that is driven by the drive source, intermittently causes the protruding cam to rotate, and a range of rotation of a drive shaft of the drive source when switching between the first pressure contact state and the second pressure contact state with use of the swinging movement of the swing arm differs from a range of rotation of the drive shaft of the drive source when the protruding cam is caused to swing with use of the intermittent transmission mechanism to switch the pressure contact state to the release state.

13. An image forming device comprising:

a transferring unit transferring a toner image on a recording sheet; and a fixing device that fixes the toner image on the recording sheet, wherein the fixing device fixes the toner image onto the recording sheet by passing the recording sheet through a nip, the fixing device comprising:

a pressure structure and a heating structure that form the nip when in pressure contact with each other; and a pressure contact state switching unit selectively switching a pressure contact state of the heating structure and the pressure structure between a first pressure contact state, a second pressure contact state, and a release state, wherein the pressure contact state switching unit comprises:

a first switcher directly switching the pressure contact state between the first pressure contact state and the second pressure contact state, and vice versa, without switching the pressure contact state to the release state;

a second switcher switching the pressure contact state between the first pressure contact state and the release state;

an acquirer acquiring information relating to which state the pressure contact state is to be switched into; and a controller controlling the first switcher and the second switcher based on the information acquired by the acquirer through driving the first switcher or the second switcher to switch the pressure contact state.

14. A pressure contact state switching device selectively switching a pressure contact state of a first structure and a second structure between a first pressure contact state, a second pressure contact state, and a release state, the pressure contact state switching device comprising:

a first switcher directly switching the pressure contact state between the first pressure contact state and the second pressure contact state, and vice versa, without switching the pressure contact state to the release state;

a second switcher switching the pressure contact state between the first pressure contact state and the release state;

an acquirer acquiring information relating to which state the pressure contact state is to be switched into; and a controller controlling the first switcher and the second switcher based on the information acquired by the acquirer through driving the first switcher or the second switcher to switch the pressure contact state.

* * * * *